US005643067A

United States Patent [19]

Katsuoka et al.

[11] Patent Number: 5,643,067

[45] Date of Patent: Jul. 1, 1997

[54] DRESSING APPARATUS AND METHOD

[75] Inventors: Seiji Katsuoka, Atsugi; Kunihiko Sakurai, Yokohama; Tetsuji Togawa, Fujisawa, all of Japan

[73] Assignee: Ebara Corporation, Tokyo, Japan

[21] Appl. No.: 571,598

[22] Filed: Dec. 13, 1995

[30] Foreign Application Priority Data

Dec. 16, 1994 [JP] Japan ..... 6-334164

[51] Int. Cl.[6] ..... B24B 21/18; B24B 33/00; B24B 47/26; B24B 55/00

[52] U.S. Cl. ..... 451/444; 451/271; 451/287; 451/56; 451/211; 451/270

[58] Field of Search ..... 451/444, 287, 451/271, 211, 270, 56

[56] References Cited

U.S. PATENT DOCUMENTS

| | | | |
|---|---|---|---|
| 3,393,474 | 7/1968 | Buswell | 451/271 |
| 5,105,583 | 4/1992 | Hammond et al. | 451/271 |
| 5,259,144 | 11/1993 | Yeh | 451/271 |
| 5,384,986 | 1/1995 | Hirose et al. | 451/444 |
| 5,486,131 | 1/1996 | Cesna et al. | 451/444 |

FOREIGN PATENT DOCUMENTS

| | | | |
|---|---|---|---|
| 421475 | 3/1974 | U.S.S.R. | 451/271 |

*Primary Examiner*—Robert A. Rose
*Assistant Examiner*—George Nguyen
*Attorney, Agent, or Firm*—Wenderoth, Lind & Ponack

[57] ABSTRACT

A dressing apparatus is used to resurface a polishing surface of a polish cloth used to polish semiconductor wafers. A dressing brush which spins on its own axis is also coupled to a drive shaft of a main drive of the dressing apparatus through a planetary gear mechanism so that the brush will rotate or orbit about the drive shaft. Therefore, the dressing brush traces a complex path and its dressing action is spread over a wide surface area of the polishing cloth to produce thorough resurfacing of the polishing surface. The service life of the cloth is significantly increased and contributes to improving the overall efficiency of preparing high quality polished semiconductor wafers. For economy, the dressing apparatus can be mounted easily on a conventional polishing apparatus having a dressing facility.

35 Claims, 5 Drawing Sheets

DRESSING APPARATUS AND METHOD

BACKGROUND OF THE INVENTION

1. Field of the Invention

The present invention relates in general to a dressing apparatus and relates in particular to a dressing apparatus used in conjunction with a polishing apparatus for producing a flat mirror polished surface on semiconductor wafers.

2. Description of the Related Art

High density integrated semiconductor devices of recent years require increasingly finer microcircuits, and the interline spacing has also shown a steadily decreasing trend. For optical lithography operations based on less than 0.5 micrometer interline spacing, the depth of focus is shallow and high precision in flatness is required on the polishing object which has to be coincident with the focusing plane of the stepper. This requirement means that the wafer surface must be made extremely flat, and a first step in achieving such precision in flatness begins with proper surface preparation by polishing with a polishing apparatus.

The conventional type of polishing apparatus used in such applications comprises a turntable with a polishing cloth mounted on a top surface, a topring, each of which having independent rotational control, and a polishing object disposed therebetween. The surface of the object to be polished is pressed down onto the polishing cloth by the topring exerting a controlled pressure while spraying an abrasive liquid on the polishing cloth from an abrasive liquid nozzle. The polishing process is continued until the polishing surface is polished to the required degree of flatness and mirror polish.

In such a polishing apparatus, the polishing cloth mounted on top of the turntable becomes clogged with particles of polishing powder which may adhere to or penetrate the polishing cloth. For this reason, the polishing cloth must be resurfaced from time to time by removing the particles and dressing the cloth. Therefore, it is necessary that a polishing apparatus be provided with a dressing facility.

FIG. 4A is a side view of a conventional dressing device and FIG. 4B is a plan view of the dressing device shown in FIG. 4A. The dressing device has a brush 32 attached to an arm 31. To perform dressing on the polishing cloth 34 mounted on the turntable 33, the turntable 33 is revolved while the tip of the brush 32 touching the polishing cloth 34 and washing solution W such as deionized water is being sprayed through a nozzle 35.

The conventional dressing device of the type shown in FIG. 4A and 4B presents some operational problems that it is difficult to wash the entire surface of the polishing cloth 34 uniformly and thoroughly, and to remove the particles adequately which become lodged in the cloth. Therefore, the serviceable life of the polishing cloth 34 is short, and the polishing cloth 34 needs to be changed frequently.

To resolve such difficulties, a dressing device shown in FIG. 5A showing a side view has been disclosed in a Japanese Laid-open Patent Publication, H6-190714. This dressing device comprises: an arm 42 for holding a revolving brush 41; and a swing device 43 for providing a swinging action for the arm 42. There is a driving source (electrical motor) 44 provided at the proximal end of the arm 42 for revolving the brush 41. The brush 41 is revolved by the driving source 44 through a force transmission device, such as a pulley belt 45, disposed inside the arm 42, and can be moved up or down by moving a support post 46 for the arm 42 so as to apply some pressure on the polishing cloth 48.

However, the dressing device described above present the following operational problems.

First, it is important that the brush be pressed against the cloth with a certain pressure. However, the construction of the dressing device is such that the brush is located at the end of a long arm, and the rigidity of the arm is insufficient to provide the required pressure because of flexing of the arm. It is also difficult to apply uniform pressure on the cloth through the brush, resulting in non-uniform dressing of the polishing cloth.

If the arm is stiffened in an effort to apply sufficient pressure on the cloth, the weight of device becomes heavy and the design of the device becomes complex.

Furthermore, in the conventional dressing device since the driving force must be transmitted through a long distance in the arm, the transmission mechanism becomes complex and requires a high maintenance work.

SUMMARY OF THE INVENTION

It is an object of the present invention to provide a dressing apparatus which enables to dress a wide surface area of a polishing cloth thoroughly and uniformly and to prolong the service life of the polishing cloth.

The object is achieved in a dressing apparatus for dressing a polishing surface of a polishing cloth mounted on a turntable of a polishing apparatus comprising: a drive shaft driven by a drive source; a brush attachment shaft protruding towards said turntable and engaged to said drive shaft by way of a drive force transmission device; wherein said brush attachment shaft is driven by the force transmitted by said drive force transmission device so as to spin on own axis as well as rotate about said axis of said drive shaft.

According to the dressing apparatus, the brush attachment shaft moves within a circle of a diameter equal to the distance between the brush attachment shaft and the drive shaft, without a swinging motion of a long arm holding the drive shaft.

According to the other aspect of the invention, a dressing apparatus further comprises a pressing means for pressing said brush attachment shaft towards said turntable.

The pressing means can be arranged within the area right above said turntable so as to be able to exert the pressing force on the drive shaft directly.

The pressing means can be arranged within a housing for supporting said drive shaft.

Further, the drive means can be retractable from the area right above said turntable so as to be convenient when the dressing is used.

According to the other aspect of the invention, a dressing apparatus for dressing a polishing surface of a polishing cloth mounted on a turntable of a polishing apparatus comprises: a drive shaft protruding towards the turntable; a support means supported on a drive shaft rotatably about a drive shaft so as to engage with the drive shaft through a planetary gear means; and a brush attachment shaft supported on the support means rotatably about an axis different from and parallel to the drive shaft axis and engaged with the drive shaft through a second gear means so as to spin on own axis as well as rotate about the axis of the drive shaft.

According to the dressing apparatus, the planetary gear means rotates the support means and rotates the brush attachment shaft supported by the support means around the driving shaft. Since the brush attachment is also connected to the drive shaft through the second gear arrangements, a double rotation action of the dressing brush is produced by the use of a planetary gear in combination with a second gear arrangement. The dressing brush traces a complex path and its dressing action is spread over a wide surface area of the polishing cloth to thorough resurface the polishing surface.

DESCRIPTION OF THE PREFERRED EMBODIMENT

Figure 1:
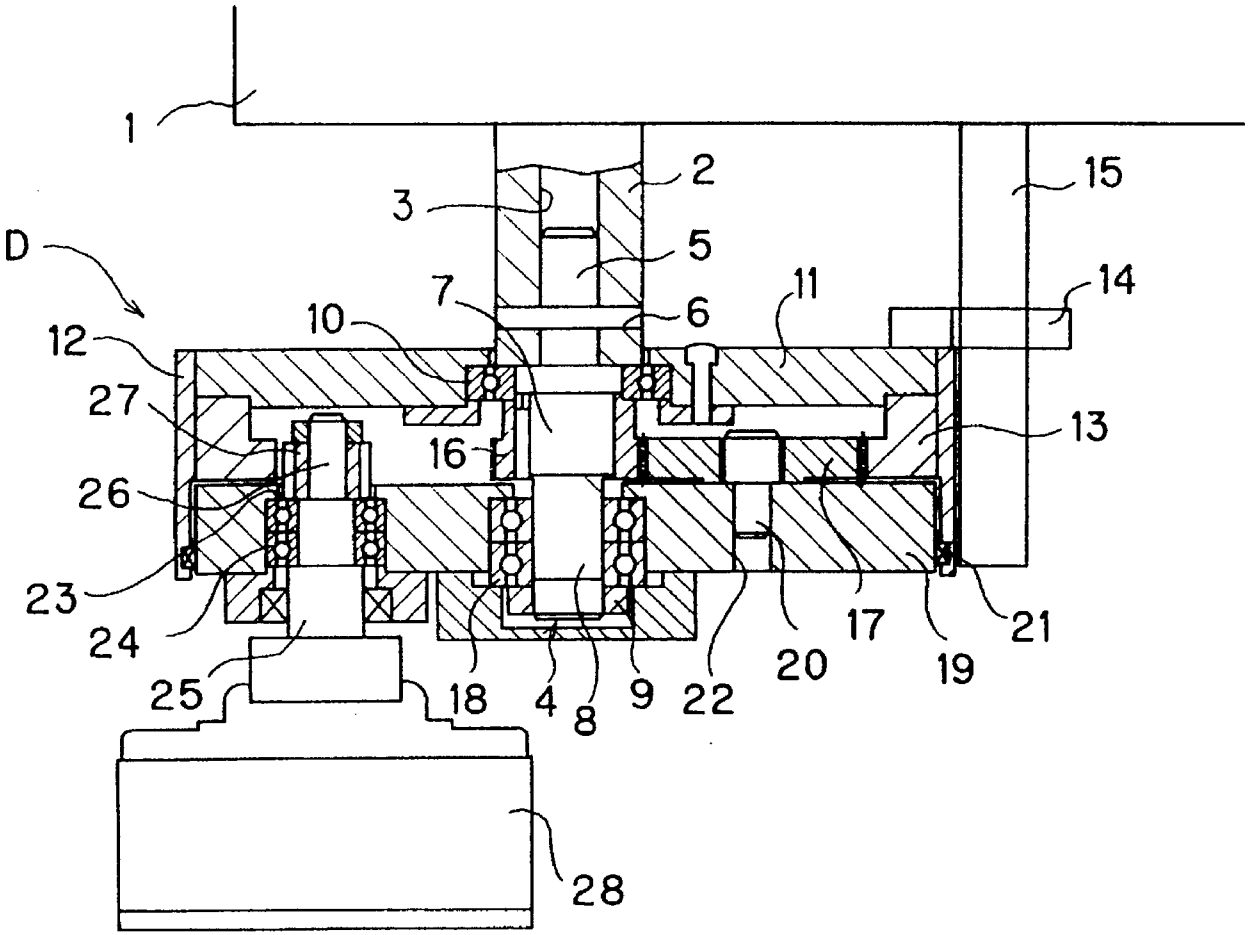
FIG. 1 is a partial cutaway front view of an embodiment of the dressing apparatus of the present invention.
Figure 2:
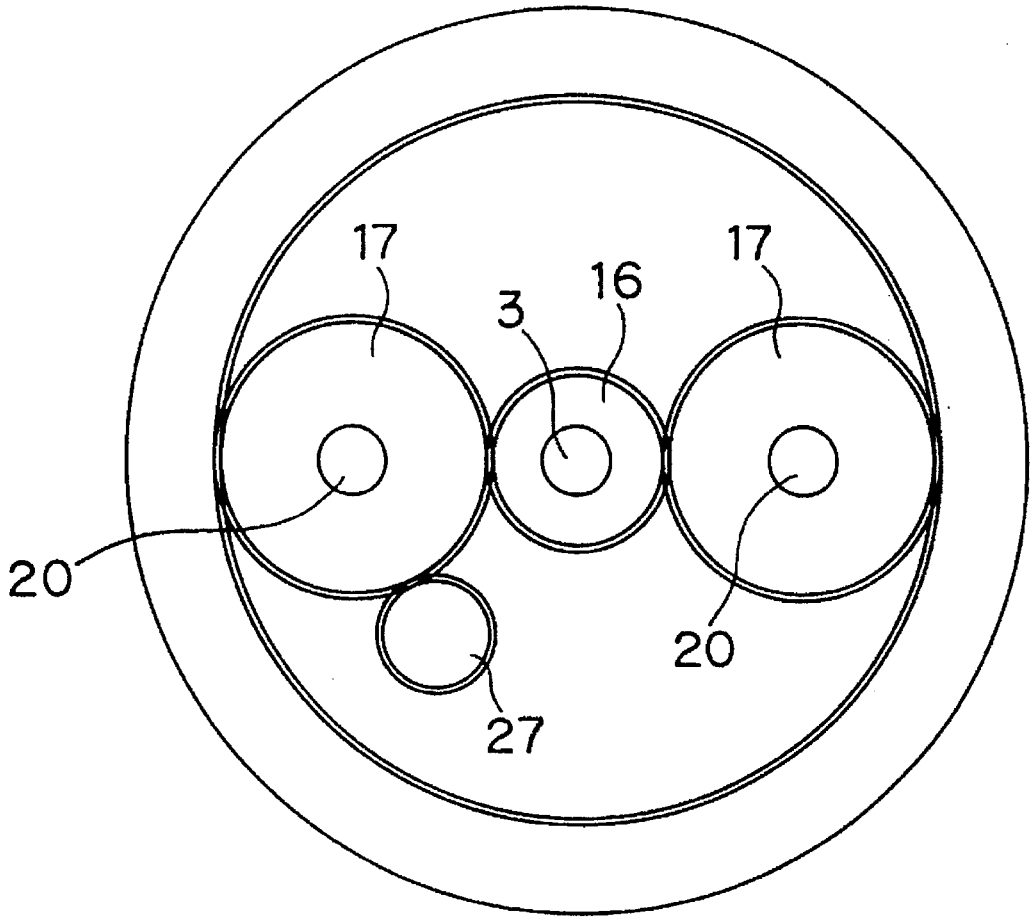
FIG. 2 is a schematic drawing of the gears used in the embodiment shown in FIG. 1.
Figure 3:
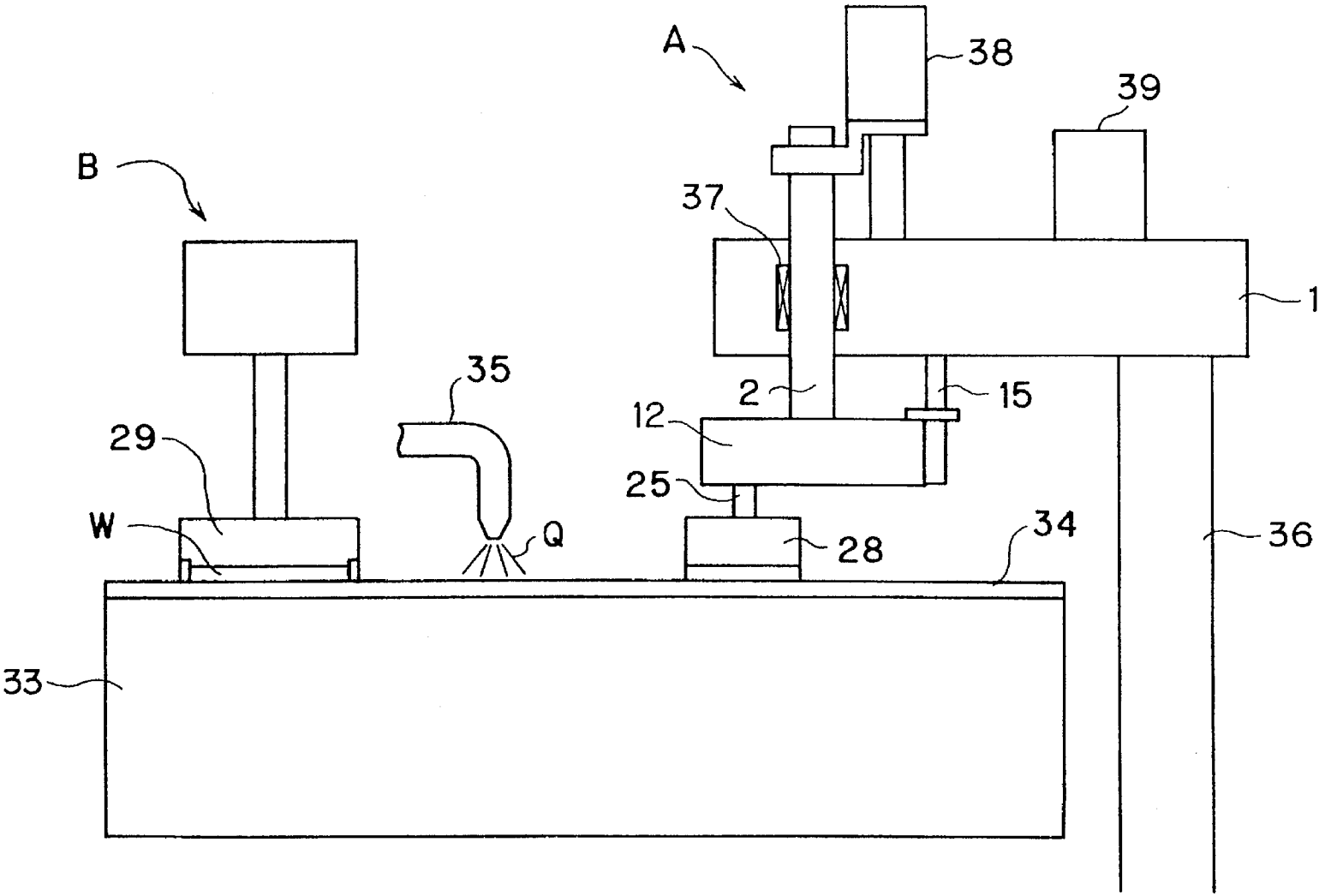
FIG. 3 is a side view of an arrangement of the dressing apparatus of the embodiment for polishing of a wafer.
Figure 4A:
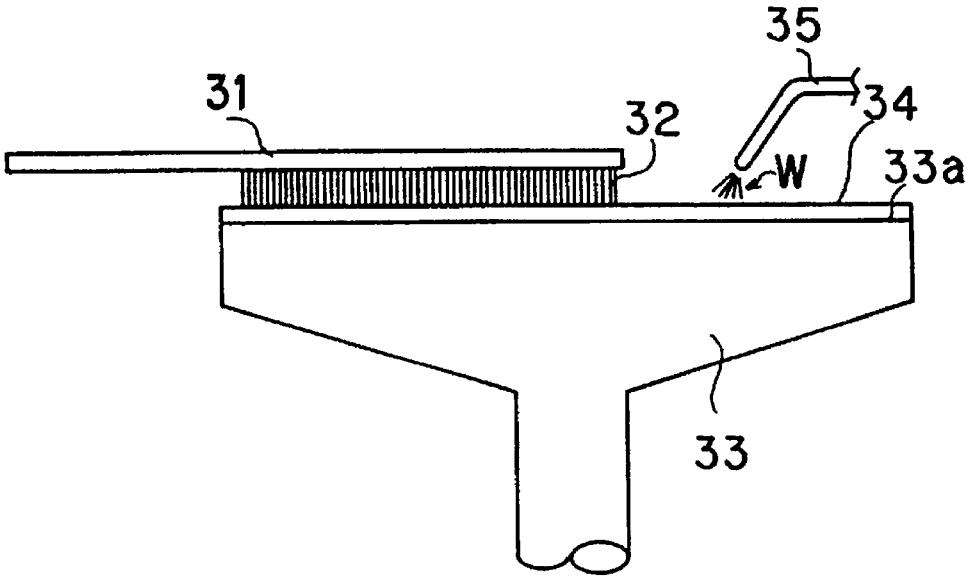
FIG. 4A PRIOR ART
FIG. 4A is a side view of a conventional dressing device.
Figure 4B:
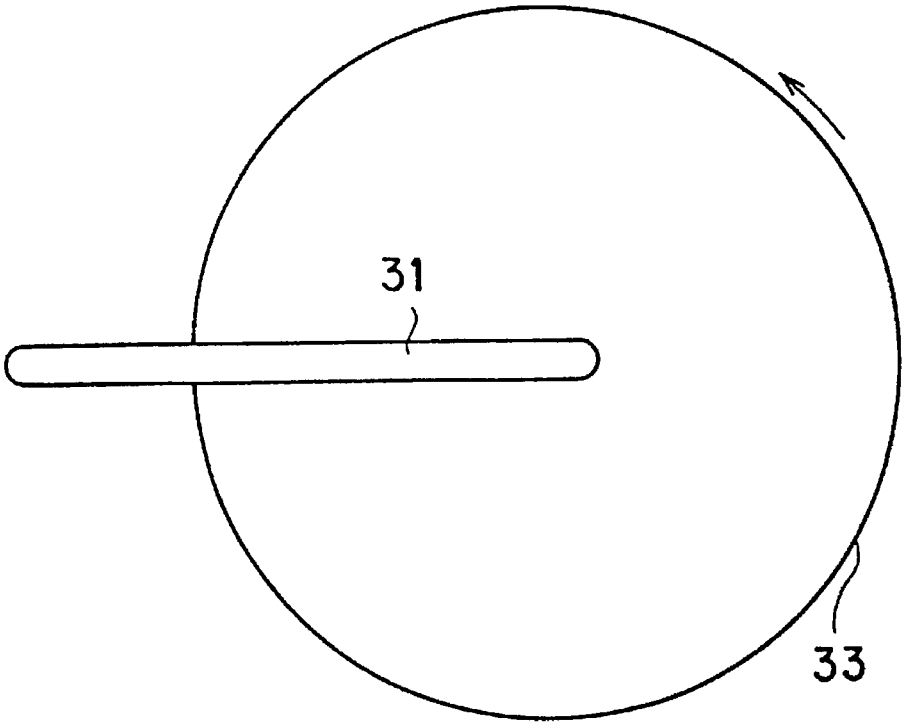
FIG. 4B PRIOR ART
FIG. 4B is a plan view of the dressing device shown in FIG. 4A.
Figure 5A:
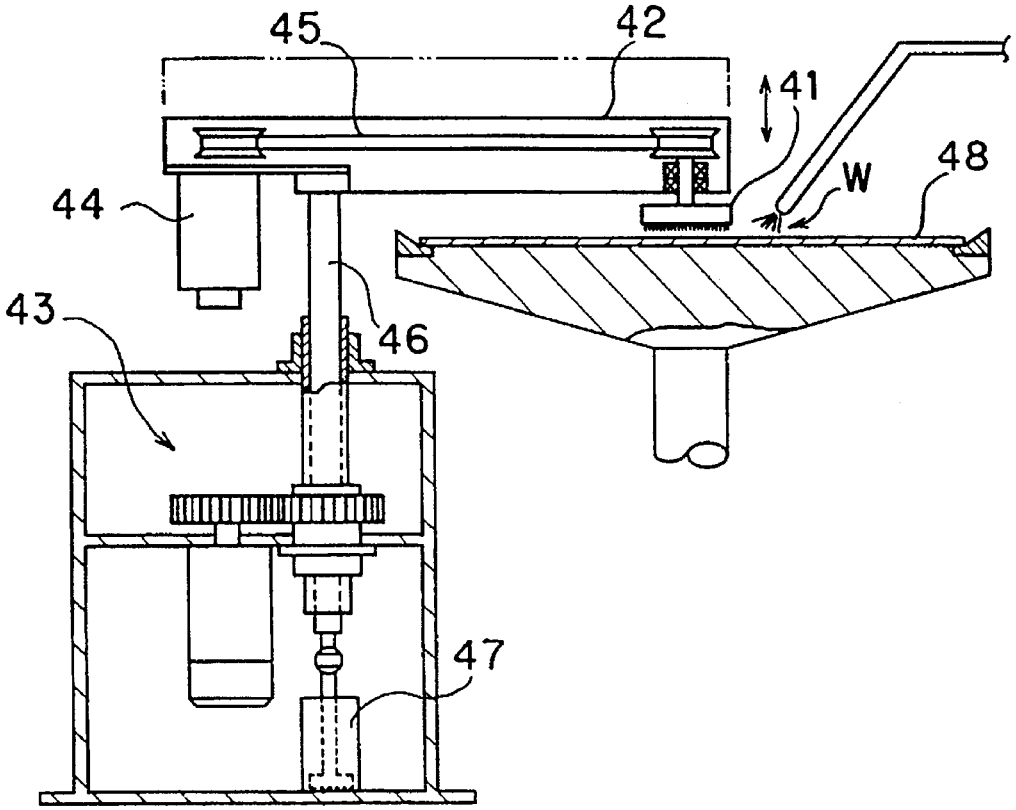
FIG. 5A PRIOR ART
FIG. 5A is a side view of another example of the conventional dressing device.
Figure 5B:
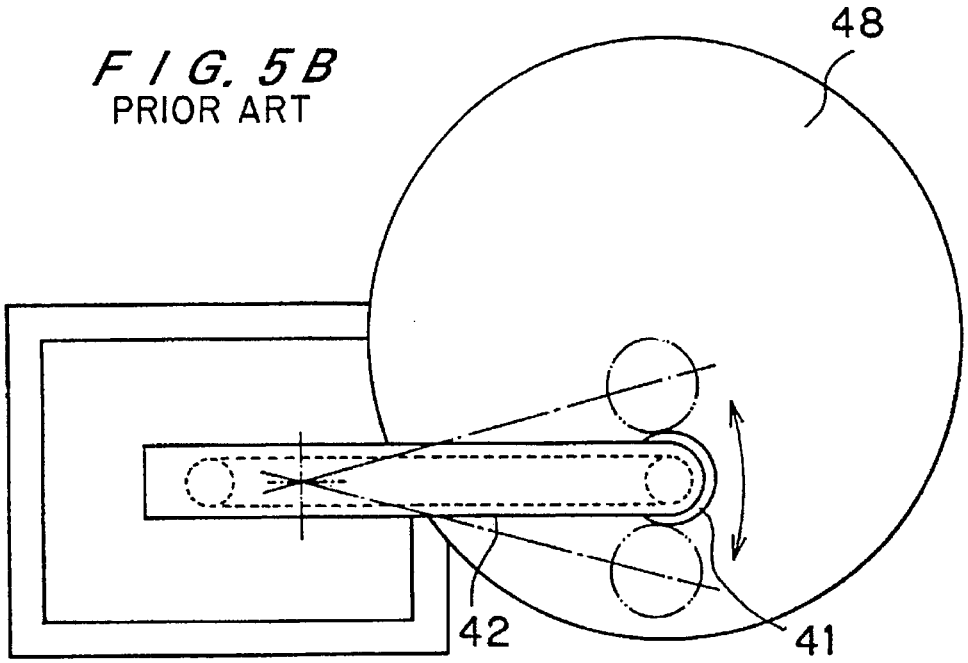
FIG. 5B PRIOR ART
FIG. 5B is a plan view of the dressing device shown in FIG. 5A.

An embodiment of the dressing apparatus will be explained in the following with reference to FIGS. 1 to 3.

The dressing apparatus comprises a housing 1 fixed at one end to the top portion of a support 36 located adjacent to a turntable 33 so as to extend over the turntable 33. A drive shaft 2 is supported slidably in a vertical direction by a slide bearing 37 arranged at the other end of the housing 1. An actuator such as an air cylinder 38 is provided on the housing 1 to move the drive shaft 2 in a vertical direction as well as press the drive shaft 2 toward the turntable 33. The bearing 37 is engaged to a drive source such as a motor 39 mounted on the housing 1 by way of a transmission device (not shown) arranged within the housing 1, thus the drive shaft 2 is held rotatable around its own axis and movable up and down. A drive device (not shown) is provided to rotate the support 36 so that it can swing the housing 1 to move the drive shaft 2 to and from the area above the turntable 33.

The dressing unit D is supported on the drive shaft 2 by inserting an inner small diameter part 5 of the main shaft 4 of the dressing unit D disposed on the inner side of the main shaft 4 into an attachment hole 3 formed through the interior of the drive shaft 2, and fixing it by means of a bolt, for example, inserted in a bolt hole 6. The main shaft 4 has a large diameter part 7 at the center and an outer small diameter part 8 on the outer side of the shaft 4. The tip end of the outer small diameter part 8 is provided with a threaded section which engages with a fixation nut 9.

The bottom end of the drive shaft 2 has a ceiling plate 11 which is attached through a bearing 10 and can freely rotate relative to the drive shaft 2. The ceiling plate 11 is surrounded by a cylindrical outer plate 12 extending downward, and an internal teeth gear 13 is provided inside the outer plate 12.

A guiding member 14 having vertical sliding grooves is provided on the top surface of the ceiling plate 11, and guiding rails 15 attached vertically to the housing 1 are provided to slide in the grooves. Around the large diameter part 7 in the center of the main shaft 4, there is a sun gear 16 attached in the locked condition. The sun gear 16 is engaged with two planetary gears 17 disposed on the outer side of the sun gear 16 as shown in FIG. 2, and the external teeth of the planetary gears 17 are engaged radially outwardly with the internal teeth gear 13. The sun gear 16, the planetary gears 17 and the internal teeth gear 13 constitute the planetary drive mechanism P.

The outer small diameter part 8 of the main shaft 4 has a disc shaped support member 19 attached thereto through a bearing 18. The support member 19 has a retention hole 22 for rotatably holding a planetary gear shaft 20 of the planetary gear 17. Therefore, the revolving action of the drive shaft 2 rotates the planetary drive mechanism P so as to entrain the planetary gear shaft 20 of the planetary gear 17 and the support member 19 supporting the planetary gear shaft 20 about the axis of the drive shaft 2 in the opposite direction thereto. The outer peripheral section of the support member 19 is in contact with the outer plate 12 through the bearing 21.

In a specific location of the support member 19, a support hole 23 is provided to rotatably support a brush attachment shaft 25 therein. A small diameter portion 26 of the attachment shaft 25 protruding upwardly from the interior side of the support member 19 has a follower gear 27. The follower gear 27 engages with the planetary gears 17 as shown in FIG. 2 and constitutes a second gear mechanism S which transmit the rotation motion of the planetary gear 17 to the follower gear 27. A dressing brush 28 is attached to the bottom end of the attachment shaft 25.

The operation of the dressing apparatus will be explained in the following.

By the action of the driving source 39, the drive shaft 2 is operated and the sun gear 16 is rotated thus transmitting the rotation motion to the two planetary gears 17. The internal teeth gear 13, the ceiling plate 11 and the outer plate 12 as a unit is in the locked position by the guiding member 14 and the guiding rails 15. Therefore, the planetary gears 17 and the support member 19 begin rotating in the opposite direction to that of the drive shaft 2, and the attachment shaft 25 supported by the support member 19 also begin rotating about the drive shaft 2. At the same time, because of the engagement of the follower gear 27, attached to the small diameter portion 26 of the attachment shaft 25, with the planetary gears 17, the attachment shaft 25 begins to spin. In other words, the dressing brush 28 rotate about the drive shaft 2 while spinning itself on the axis of its own brush attachment shaft 25.

The spinning speed of the brush attachment shaft 25 is determined by the gear ratio of the sun gear 16 and the planetary gears 17, and the self-revolving speed of the brush attachment shaft 25 is determined by the gear ratio of the sun gear 16 and the follower gear 27. Therefore, each value of rotation speed can be set independent of the other.

The use of the dressing apparatus will be explained with reference to a schematic block diagram of the polishing setup shown in FIG. 3. In FIG. 3, the dressing apparatus is indicated by A, and B refers to a polishing apparatus comprising a topring 29 for holding a wafer W at the bottom surface thereof. The polishing apparatus B comprises a turntable 33 covered with a polishing cloth 34, and a spray nozzle 35 for spraying an abrasive liquid Q to the polishing surface or the dressing surface. During a dressing operation, the turntable 33 is revolved while the drive shaft 2 is pressed down thereon so that the dressing brush 28 bears against the polishing cloth 34 with a certain pressure.

The revolving motion of the turntable 33, the spinning of the brush attachment shaft 25 and the rotation about the drive shaft 2 produce a complex pattern of traces on the polishing cloth 34. Because of this complex pattern of motion of the dressing brush 28, dressing action is not localized and the surface of the polishing cloth 34 is dressed uniformly all across its surface. It is permissible to perform dressing while polishing as shown in FIG. 3, or separately on its own.

When the size of the polishing cloth 34 is altered, it is necessary to change the dressing motion ranger and this is achieved readily by having spare dressing apparatuses D so that a proper diameter dressing unit can be used for each size of the polishing cloth 34, by simply sliding out the main shaft 4 by removing the bolt through the bolt hole 6.

The arrangement of the dressing apparatus A assures that the downward pressure exerted on the drive shaft 2 is uniformly transmitted to the polishing cloth 34 by way of the dressing brush 28 so that it can prevent polishing problems such as local lifting of the polishing cloth 34. Therefore wear of the polishing cloth 34 is minimized, and dressing of the polishing cloth 34 can be performed uniformly and efficiently to improve the service life of the polishing cloth 34 and significantly improving the polishing operation.

The utility of the dressing apparatus A is enhanced because the dressing apparatus A can be installed by attaching it to a drive shaft of any existing conventional type of polishing devices. There is no need for a special procedure or capital investment required in using the dressing apparatus.

To summarize the advantages of the dressing apparatus of the present invention, it enables to dress a wide surface area of a polishing cloth thoroughly and uniformly and to prolong the service life of the polishing cloth, thereby contributing to improve the efficiency of polishing operation. The use of the dressing apparatus is enhanced by the fact that only a simple modification is required to adapt the present dressing apparatus to the conventional polishing device.

What is claimed is:

1. A dressing apparatus for dressing a polishing surface of a polishing cloth, said apparatus comprising:

a table to mount thereon a polishing cloth, said table being movable in a plane parallel to the polishing cloth when mounted on said table;

a drive shaft having an axis, said drive shaft being rotatable about said axis thereof;

a dressing tool attachment shaft having an axis and to support a dressing tool directed toward said table; and a drive force transmission assembly operably connected to said drive shaft and to said attachment shaft such that, as said drive shaft is rotated about said axis thereof, said attachment shaft is caused to rotate about said axis thereof and to orbit about said axis of said drive shaft.

2. A dressing apparatus as claimed in claim 1, wherein said drive force transmission assembly comprises a planetary gear mechanism.

3. A dressing apparatus as claimed in claim 2, wherein said drive force transmission assembly further comprises a secondary gear mechanism.

4. A dressing apparatus as claimed in claim 2, wherein said planetary gear mechanism comprises a sun gear fixed to said drive shaft and rotatable therewith, an internal teeth gear fixed about said sun gear, and at least one planetary gear positioned between and meshing with said sun gear and said internal teeth gear.

5. A dressing apparatus as claimed in claim 4, further comprising a support member mounted about said drive shaft for relative rotation therebetween, said at least one planetary gear being rotatably supported by said support member, and said attachment shaft being rotatably supported by said support member.

6. A dressing apparatus as claimed in claim 5, further comprising a follower gear fixed to said attachment shaft and meshing with said at least one planetary gear.

7. A dressing apparatus as claimed in claim 1, further comprising a pressing device operable to move said attachment shaft toward said table.

8. A dressing apparatus as claimed in claim 7, wherein said pressing device is operable to move said drive shaft and said attachment shaft toward said table.

9. A dressing apparatus as claimed in claim 7, wherein said pressing device is located directly above said table.

10. A dressing apparatus as claimed in claim 7, further comprising a housing supporting said drive shaft for relative movement axially thereof, said pressing device being mounted on said housing and operable to move said drive shaft axially thereof relative to said housing.

11. A dressing apparatus as claimed in claim 1, further comprising a dressing tool connected to said attachment shaft.

12. A dressing apparatus as claimed in claim 11, wherein said dressing tool comprises a dressing brush.

13. A dressing apparatus as claimed in claim 11, further comprising a polishing cloth mounted on said table, said polishing cloth having a polishing surface having an area sufficient to include an entire locus of movement of said dressing tool during rotation of said attachment shaft about said axis thereof and orbiting of said attachment shaft about said axis of said drive shaft.

14. A dressing apparatus as claimed in claim 1, wherein said drive shaft is movable from a position directly above said table to a position spaced laterally thereof.

15. A dressing apparatus as claimed in claim 1, wherein said table comprises a turntable rotatable about an axis thereof.

16. A polishing apparatus for polishing a surface of a workpiece, said polishing apparatus comprising a movable table having thereon a polishing cloth, a top ring operable to press a workpiece against a polishing surface of said polishing cloth, and a dressing apparatus for dressing said polishing surface, said dressing apparatus comprising:

a drive shaft having an axis, said drive shaft being rotatable about said axis thereof;

a dressing tool attachment shaft having an axis and supporting a dressing tool directed toward said table; and a drive force transmission assembly operably connected to said drive shaft and to said attachment shaft such that, as said drive shaft is rotated about said axis thereof, said attachment shaft is caused to rotate about said axis thereof and to orbit about said axis of said drive shaft.

17. A polishing apparatus as claimed in claim 16, wherein said drive force transmission assembly comprises a planetary gear mechanism.

18. polishing apparatus as claimed in claim 17, wherein said drive force transmission assembly further comprises a secondary gear mechanism.

19. A polishing apparatus as claimed in claim 17, wherein said planetary gear mechanism comprises a sun gear fixed to said drive shaft and rotatable therewith, an internal teeth gear fixed about said sun gear, and at least one planetary gear positioned between and meshing with said sun gear and said internal teeth gear.

20. A polishing apparatus as claimed in claim 19, further comprising a support member mounted about said drive shaft for relative rotation therebetween, said at least one planetary gear being rotatably supported by said support member, and said attachment shaft being rotatably supported by said support member.

21. A polishing apparatus as claimed in claim 20, further comprising a follower gear fixed to said attachment shaft and meshing with said at least one planetary gear.

22. A polishing apparatus as claimed in claim 16, further comprising a pressing device operable to move said attachment shaft toward said table.

23. A polishing apparatus as claimed in claim 22, wherein said pressing device is operable to move said drive shaft and said attachment shaft toward said table.

24. A polishing apparatus as claimed in claim 22, wherein said pressing device is located directly above said table.

25. A polishing apparatus as claimed in claim 22, further comprising a housing supporting said drive shaft for relative movement axially thereof, said pressing device being mounted on said housing and operable to move said drive shaft axially thereof relative to said housing.

26. A polishing apparatus as claimed in claim 16, wherein said dressing tool comprises a dressing brush.

27. A polishing apparatus as claimed in claim 16, wherein said polishing surface has an area sufficient to include an entire locus of movement of said dressing tool during rotation of said attachment shaft about said axis thereof and orbiting of said attachment shaft about said axis of said drive shaft.

28. A polishing apparatus as claimed in claim 16, wherein said drive shaft is movable from a position directly above said table to a position spaced laterally thereof.

29. A polishing apparatus as claimed in claim 16, wherein said table comprises a turntable rotatable about an axis thereof.

30. A polishing apparatus as claimed in claim 16, for polishing semiconductor wafers.

31. A method of dressing a polishing surface of a polishing cloth mounted on a table, said method comprising:

contacting said polishing surface with a dressing tool mounted on an attachment shaft that is driveably connected to a drive shaft; and moving said table in a plane parallel to said polishing cloth while causing said dressing tool to rotate about an axis of said attachment shaft and to orbit about an axis of said drive shaft.

32. A method as claimed in claim 31, further comprising pressing said dressing tool against said polishing surface.

33. A method as claimed in claim 32, wherein said pressing comprises moving said drive shaft and said attachment shaft toward said table.

34. A method as claimed in claim 31, wherein said moving comprises rotating said table about an axis thereof.

35. A method as claimed in claim 31, wherein said dressing is conducted at a first location on said polishing surface, and further comprising simultaneously polishing a surface of a workpiece at a second location on said polishing surface.

* * * * *